United States Patent [19]

Powell

[11] 4,022,482

[45] May 10, 1977

[54] SKI DEVICE

[76] Inventor: William Powell, R.D. No. 1, Box 857, Newton, N.J. 07860

[22] Filed: Dec. 19, 1975

[21] Appl. No.: 642,462

[52] U.S. Cl. ..... 280/11.37 E; 280/601; 280/607

[51] Int. Cl.[2] ..... A63C 11/00

[58] Field of Search ..... 280/607, 601, 600, 636, 280/11.37 E, 11.37 R; 9/310 A, 310 AA, 310 C; 36/117; 272/70, 97

[56] References Cited

UNITED STATES PATENTS

| | | | |
|---|---|---|---|
| 2,611,624 | 9/1952 | Gurvich | 280/11.37 E |
| 2,625,405 | 1/1953 | Staff | 280/11.37 E |
| 3,411,224 | 11/1968 | Wagner | 280/11.37 E |
| 3,685,846 | 8/1972 | Schmid | 280/607 |
| 3,854,738 | 12/1974 | Fish | 280/607 |
| 3,863,944 | 2/1975 | Waddel | 280/11.37 E |

*Primary Examiner*—Joseph F. Peters, Jr.
*Assistant Examiner*—David M. Mitchell
*Attorney, Agent, or Firm*—Paul J. Sutton

[57] ABSTRACT

A ski device is provided for permitting a skier to ski on one ski with his other ski (or with his boot if he is not wearing a second ski) being supported in an elevated position and out of contact with the skiing surface. The present invention includes a generally L-shaped bracket having a first portion that is adapted to support either the skier's boot or the skier's ski that is not being used. A second portion of the bracket is coupled to the other ski of the pair or ski boot. The accessory aspect of the present invention can be interchangeably used with either leg of a skier. In one embodiment of the invention, the bracket is secured to a mounting member that is positioned on the ski. In another embodiment of the invention, the bracket is coupled to the boot of the ski that is being used, while in a third embodiment the bracket is mounted directly to the ski that is being used. The bracket may be mounted by means of spring clips, screws or other suitable fasteners.

8 Claims, 9 Drawing Figures

14
12
18
10
20
2
3
22
24
38
30
34
28
32
3
16
2
36

46
42
44
14
12
10
30
20
22
38
24
16
28
26
32
36
34

44
42
14
18
12
38
16
10
30
20
26
34
32
32
36

SKI DEVICE

The present invention relates generally to the skiing art and more particularly to a ski accessory.

There are many instances wherein a skier desires to use only one ski. When doing so the skier raises his other leg so that his other ski, or his boot if he is not wearing a second ski, is out of contact with the skiing surface. It will be readily appreciated that this can be very difficult, very tiresome and, therefore, can be very dangerous unless the leg that is not being used by the skier is supported in some manner. The present invention provides an accessory for supporting one of the skier's legs so that he may use only a single ski if he so desires.

In its broadest aspect, the present invention provides bracket means having a first portion that is adapted to support one of the two boots or one of the two skis of a skier at a position that is above and which is out of contact with the skiing surface. Means are also provided in the broadest aspect of the present invention for removably supporting a second portion of the bracket on the ski or by the ski boot that the skier is using.

A mounting member is provided for receiving the second portion of the bracket with the mounting member being adapted to be attached, in one embodiment of the invention, to the upper surface of one of the skis whereby the other ski or the ski boot that is not being used may be supported on the first portion of the bracket. In the first embodiment of the invention, the bracket is generally L-shaped and the mounting member is defined by a pair of spaced-apart side walls, each having a slot formed therein whereby the second portion of the bracket may be inserted into either one of the slots. The mounting member further includes a transverse wall that connects the side walls. Alternatively, a U-shaped spring clip may be secured to the second portion of the L-shaped bracket with the U-shaped spring clip being depressed so that it passes through one of the slots in the side walls of the mounting member. When the spring clip is released, a protrusion therein which is disposed inwardly of the side walls of the mounting member will prevent inadvertent removal of the bracket. By compressing the spring member, the bracket may be removed.

In still another embodiment of the present invention the ski is provided with a counterbored hole in which a nut is positioned. A fastener, such as a screw or the like, then passes through the second portion of the bracket means and is threaded into the nut.

In still another embodiment of the invention, a mounting member is secured either to the underside of the boot or to the upper surface of the ski by any suitable fastener means. One end of the mounting member may be provided with a socket for receiving the second portion of the bracket. Alternatively, the socket may be formed on the second portion of the bracket in order to receive a post that is formed at the exposed end of the mounting member.

Accordingly, it is an object of the present invention to provide an improved skiing accessory that permits the use of only one ski while providing support for the other ski or for the boot of the skier that is not then being used.

Another object of the present invention is to provide an improved skiing accessory, as described above, that may be used with either the left or right ski, or with the left or right ski boot.

A further object of the present invention is to provide an improved skiing accessory, as described above, wherein a portion thereof is rigidly secured to one of the skis and the remaining portion thereof may be readily inserted or removed therefrom.

Yet a further object of the present invention is to provide an improved skiing accessory, as described above, wherein a portion thereof is rigidly secured to one of the skier's boots with the remaining portion of the accessory being readily inserted therein or removed therefrom.

The invention will be more clearly understood from the following description of specific embodiments of the invention, together with the accompanying drawings wherein similar reference characters denote similar elements throughout the several views and in which.

Figure 1:
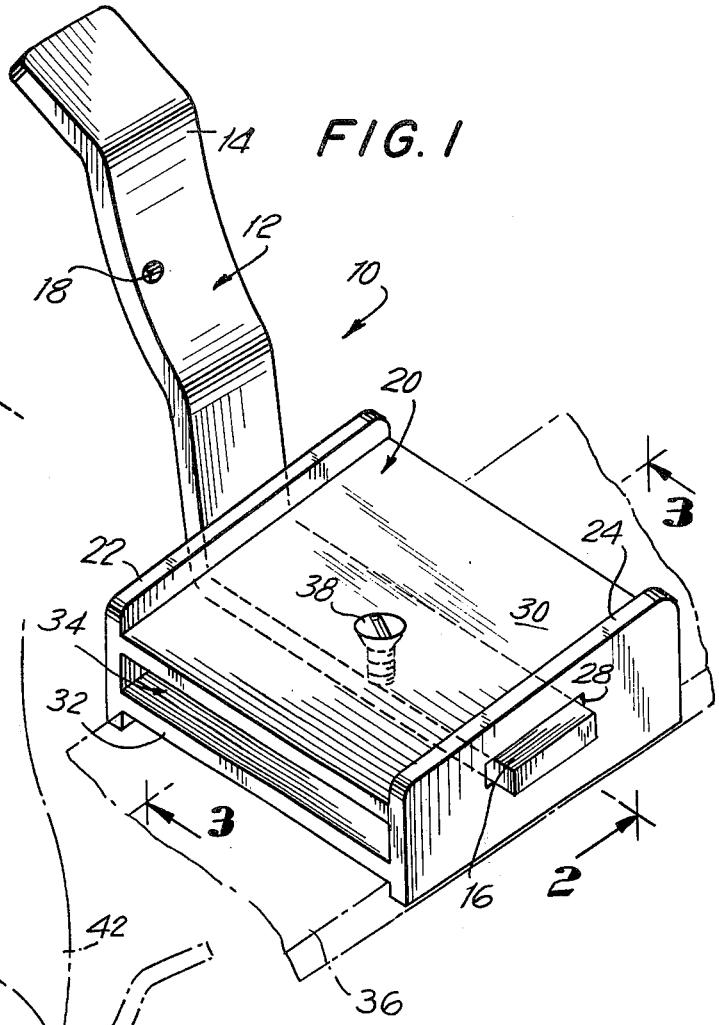
FIG. 1 is a perspective view of one embodiment of the present invention with a ski that is adapted to be used therewith being shown in phantom outline.
Figure 2:
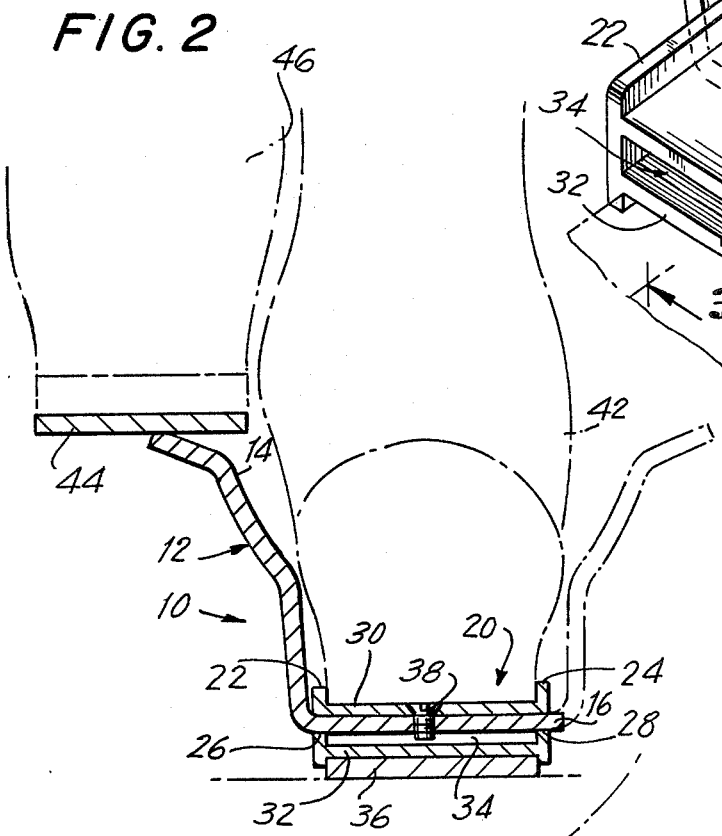
FIG. 2 is a transverse sectional elevational view taken along line 2—2 of FIG. 1 with a ski boot used therewith being shown in phantom.
Figure 3:
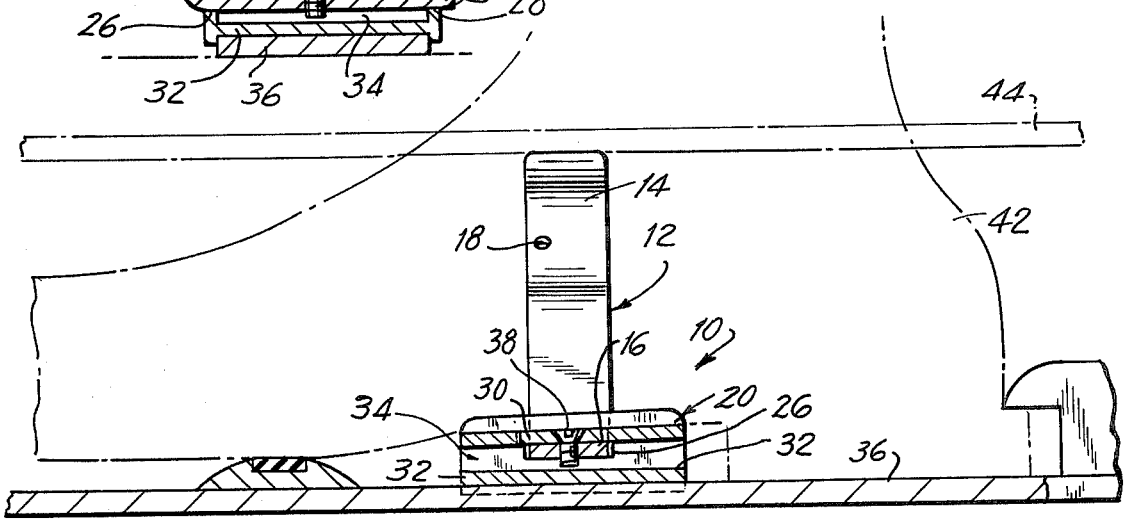
FIG. 3 is a sectional side elevational view taken along line 3—3 of FIG. 1 with a boot that is adapted to be used therewith being shown in phantom outline.

Referring first to FIGS. 1–3, a ski accessory 10 is shown constituting one embodiment of the present invention. The ski accessory 10 is comprised of a bracket 12 that is generally L-shaped and has a first upwardly direction portion 14 and a second generally horizontally directed portion 16. The bracket 12 may be fabricated from any sufficiently rigid metal or plastic material and, for convenience, is provided with a hole 18 in the first portion 14 thereof so that the bracket 12 may be connected to a ski binding when in use, or tied to the wearer's belt, for example, when it is not in use.

In the first embodiment of the present invention, there is also provided a mounting member generally designated by the reference character 20 which may also be made of any suitably rigid metal or plastic material. The mounting member 20 is comprised of a pair of laterally spaced-apart side walls 22 and 24 each of which includes a slot 26 and a slot 28, respectively. First and second transverse walls 30 and 32 are formed integrally with the side walls 22 and 24. It will be noted in FIG. 2 that a space 34 is formed between the transverse walls 30 and 32 in order to receive the second portion 16 of the bracket 12. It will be further noted in FIG. 2 that the side walls 22 and 24 extend below the lower transverse wall 32 in order to define flanges that are spaced apart from each other by a distance that is sufficient to engage the longitudinal side edges of the ski 36.

A screw 38 (FIGS. 1 and 2) is used to removably mount the second portion 16 of the bracket 12 to the mounting member 20. This should present no difficulty since the mounting member 20 is adapted to fit under the arch of the ski boot 42, as shown best in FIG. 3.

To use the present invention, the bracket 20 is inserted through the aligned slots 26 and 28. As shown in phantom outline in FIG. 2, the second portion 16 of the bracket 12 may be inserted first either through the opening 26 as shown in solid outline or through the opening 28 as shown in phantom outline. When so positioned, the other ski 44 may then rest on the upper end of the first portion 14 of the bracket 12. If the skier is not wearing two skis then his other boot 46 may be positioned on the upper end of the first portion 14 of the bracket 12.

Figure 4:
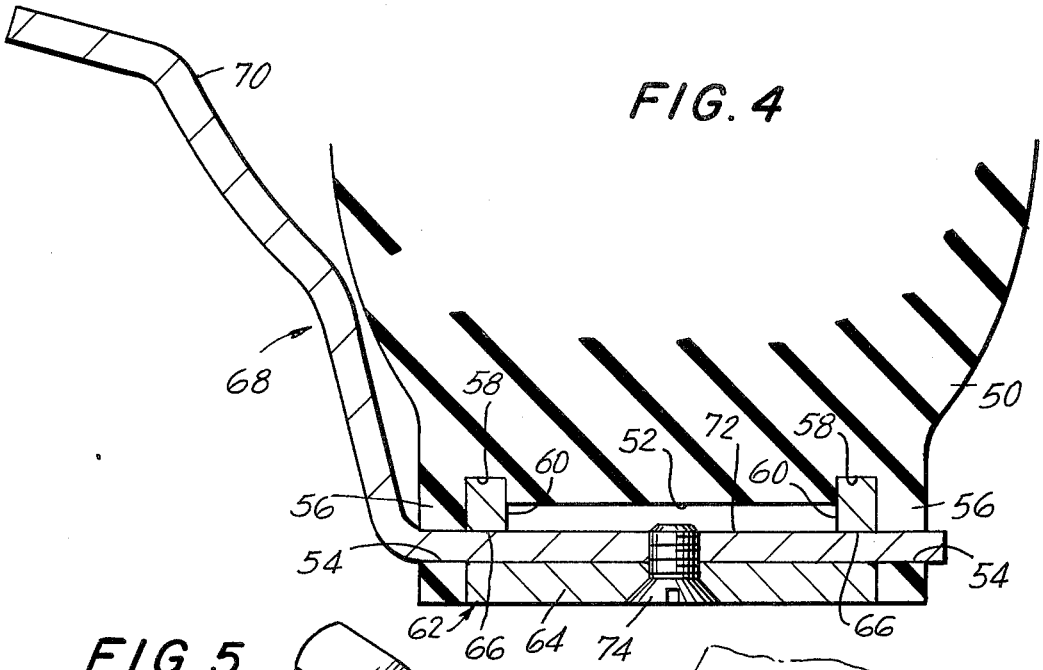
FIG. 4 is a transverse sectional elevational view, similar to FIG. 2, illustrating an alternative embodiment of the present invention.

An alternative embodiment of the present invention is disclosed in FIG. 4. Therein it will be seen that a modified boot 50 is employed having a recess 52 formed in the bottom thereof. A pair of aligned slots 54 are also formed in the side walls 56 of the recess 52. A pair of laterally spaced-apart longitudinally extending channels 58 may also be formed in the recess 52 in order to receive the laterally spaced-apart side walls 60 of a mounting member 62 which also includes a transverse wall 64 that connects the side legs 60 thereof. A pair of aligned slots 66 are formed in the side walls 60 of the mounting member 62 with the slots 66 being aligned with the slots 54 in the side walls of the recess 52.

A bracket, generally designated by the reference character 68 is provided with a first upper portion 70 and a second lower portion 72. The upper portion 70 of the bracket 68 is adapted to support either the other ski or the other boot of the skier in a manner described in connection with the first embodiment. The second portion 72 of the bracket 68 is received through the aligned slots 54 and 66 and is secured in place by means of a fastener 74 that passes through the transverse wall 64 of the mounting member 62 and is threaded into the second portion 72 of the bracket 68. As with the first embodiment described hereinabove, it will be appreciated that the second embodiment may also be inserted from either side of the boot.

Figure 5:
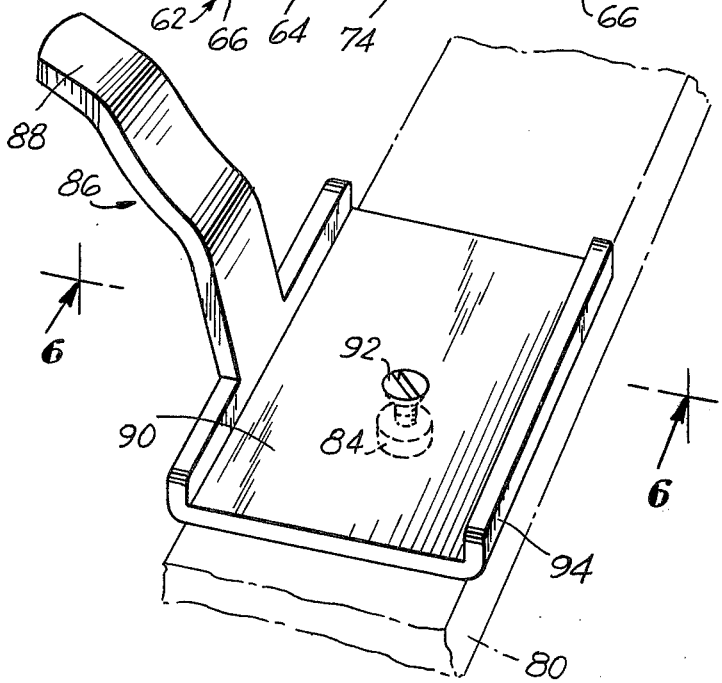
FIG. 5 is a perspective view of another alternative embodiment of the present invention with a ski that is adapted to be used therewith being shown in phantom outline.
Figure 6:
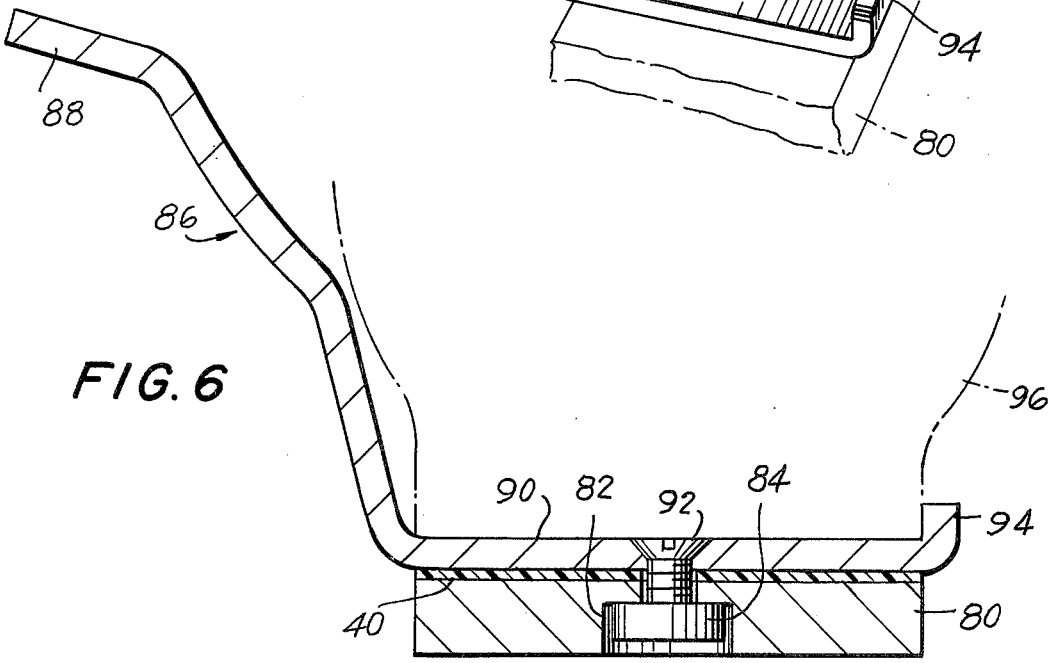
FIG. 6 is a transverse sectional elevational view taken along line 6—6 of FIG. 5.

FIGS. 5 and 6 illustrate still another alternative embodiment of the present invention. In this third embodiment the ski 80 is provided with a counter bore hole 82 in order to receive a nut 84. A bracket 86 is provided having a first, upper end 88 that is adapted to support either the unused ski or the other boot of the skier. The bracket 86 is further provided with a second, lower portion 90 that is secured to the ski 80 by means of a screw 92 that is threaded into the nut 84. The end of the second portion 90 of the bracket 86 that is remote from the first portion 88 is provided with an upwardly turned flange 94 that is arranged to engage the side edge of the boot 96. It will be appreciated that this third embodiment may also be applied from either side of the boot in the same manner as described in connection with the first two embodiments. A teflon or low friction washer or coating 40 is shown in FIG. 6 intermediate second portion 90 and the ski 80 to permit a swiveling or pivoting movement of the skier's boot, thereby enabling and not restricting the release action afforded by the ski binding.

Figure 7:
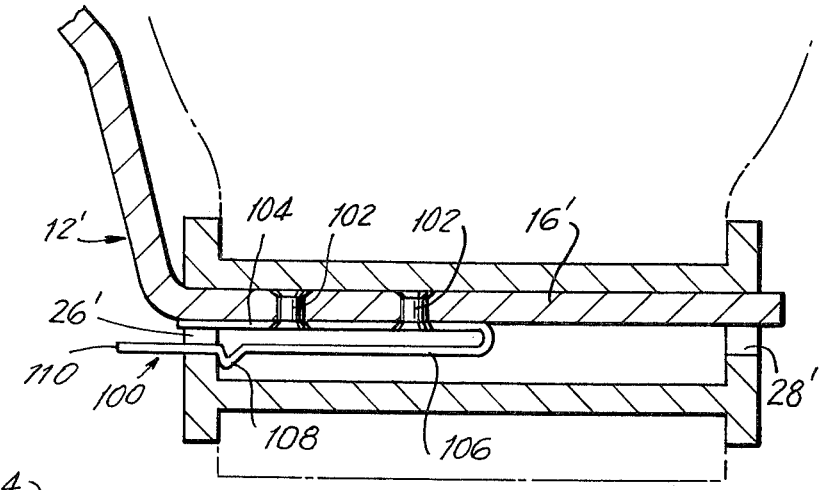
FIG. 7 is a transverse sectional elevational view, similar to FIG. 2, illustrating alternative means for removably coupling several of the components comprising the present invention.

In FIG. 7 there is illustrated an alternative fastening arrangement for the first described embodiment. Instead of using the screw 38 a spring clip 100 is secured to the second portion 16′ of the bracket 12′ by means of rivets 102. It will be seen in FIG. 7 that the rivets 102 pass through only one leg 104 of the spring clip 100. The other leg 106 of the spring clip 100 is provided with an enlargement 108 so that when the spring clip 100 is compressed, the enlargement 108 will fit through either one of the oversized slots 26′ or 28′. When it is desired to remove the bracket 12′ the free end 110 of the spring clip 100 is once again compressed so that the enlargement 108 may once again pass through the oversized slot 26′.

Figure 8:
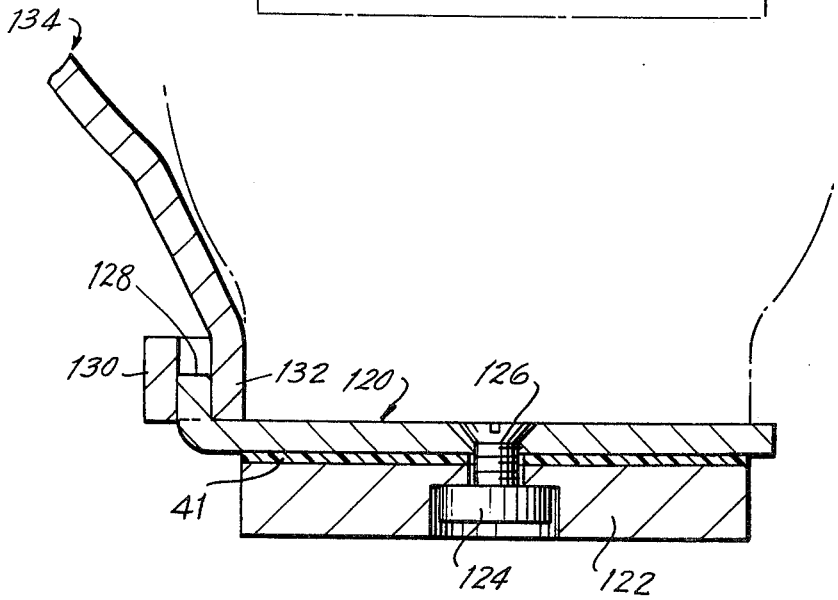
FIG. 8 is a transverse sectional elevational view similar to FIG. 2 illustrating an alternative embodiment of the present invention.
Figure 9:
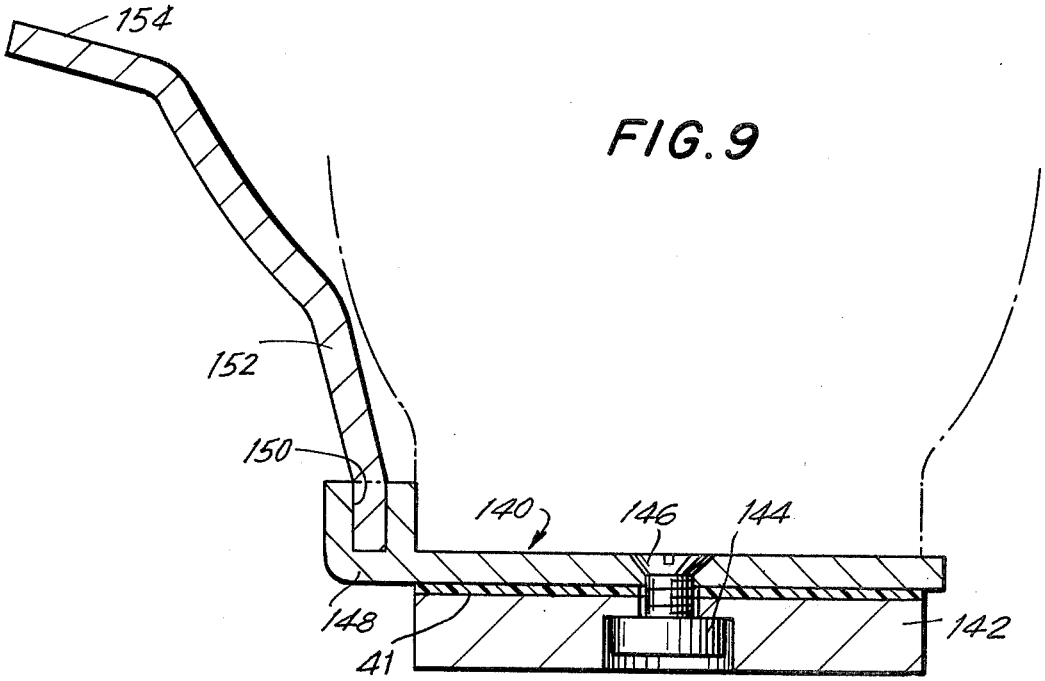
FIG. 9 is a transverse sectional elevational view illustrating a modification of the embodiment shown in FIG. 8.

Turning now to FIGS. 8 and 9 there will be seen still another embodiment of the present invention. A mounting member 120 is secured to the upper surface of a ski 122 by means of a nut 124 and a screw 126 in much the same manner as described in connection with the embodiment of FIGS. 5 and 6. One end of the mounting member 120 is provided with an upstanding post 128 that is adapted to be received in a socket 130 formed in the lower, second portion 132 of a bracket generally designated by the reference character 134. It will be appreciated that this last described embodiment may be applied from either side of the boot in the same manner as described in connection with the previous embodiment.

A modification of the FIG. 8 structure is shown in FIG. 9. A mounting member 140 is secured to a ski 142 by means of a nut 144 and a screw 146 in much the same manner as described in connection with the FIG. 5 embodiment. One end 148 of the mounting member 140 is provided with a socket 150 in order to receive the second, lower portion 152 of a bracket 154. It will once again be understood that this last mentioned embodiment may also be applied from either side of the boot.

As in the case of washer or coating 40 described above for FIG. 5, a similar washer or coating 41 is provided for identical purposes in the embodiments shown in FIGS. 8 and 9, in order to facilitate the releasing action of the skier's boot from its binding, thereby affording an added degree of safety.

The embodiments of the invention particularly disclosed here are presented merely as examples of the invention. Other embodiments, forms and modifications of the invention, coming within the proper scope of the appended claims, will, of course, readily suggest themselves to those skilled in the art.

What is claimed is:

1. An accessory for use with ski apparatus, or the like, comprising, in combination: a generally L-shaped bracket member having a first portion that is capable of supporting one foot of a skier at a position that is above and out of contact with a skiing surface, and attachment means for attaching a lower second portion of said bracket member to ski apparatus carried by the opposite foot of the skier, said attachment means comprising a pair of laterally spaced apart side surfaces each having a slot formed therein whereby said second portion of said bracket member may be inserted into either one of said slots, said attachment means further including a transverse wall connecting said side surfaces, said attachment means further including a fastener passing through said transverse wall and interconnecting said second portion of said bracket member and said attachment means.

2. An accessory according to claim 1 wherein said slots are aligned with each other whereby said second portion of said bracket member passes through both said slots.

3. An accessory according to claim 1 wherein there is further included a second transverse wall extending between said side surfaces and fastener means for securing said second transverse wall to the upper surface of a ski, said second portion of said bracket means being positioned between said first and said second transverse walls.

4. An accessory according to claim 1 wherein the spacing between said side surfaces of said attachment means is sufficient to permit the engagement thereof with the side edges of a ski boot.

5. An accessory according to claim 1 wherein said attachment means comprises a resilient clip secured to said second portion of said bracket member, said clip being compressible and thereby insertable through one of said slots, said clip being free to expand after passing through said one slot and including means for preventing the removal thereof absent a compressive force being applied thereto.

6. An accessory according to claim 1 for use with a ski boot and wherein the underside of the ski boot has a recess defined by a pair of laterally spaced apart sidewalls having aligned slots therein, said attachment means being generally U-shaped and having aligned slots in the spaced apart side surfaces thereof, said attachment means being positioned in the recess of the ski boot whereby the slots in the side walls of the recess are aligned with the slots in the side surfaces of said attachment means so that said second portion of said bracket member may pass therethrough from either side of the ski boot.

7. An accessory according to claim 6 wherein said fastener is a screw passing through said mounting member, said screw being threaded into said second portion of said bracket means.

8. An accessory for use with ski apparatus or the like, comprising, in combination: a generally L-shaped bracket member having a first upper portion that is capable of supporting one foot of a skier and any ski carried by said foot at a position that is above and out of contact with a skiing surface, and attachment means for attaching a second lower portion of said bracket member to ski apparatus carried by the opposite foot of the skier, said attachment means comprising a rotatable fastener extending through said bracket member, a fastener-receiving member disposed within an opening within said ski apparatus, said fastener and fastener receiving member being cooperatively interconnected such that said bracket member is made integral with the ski apparatus upon rotation of said fastener, wherein one of said first upper portion and said second lower portion comprises a post member and the other comprises a mating socket, whereby said first portion is separable from said second portion.

* * * * *